US008203586B2

(12) United States Patent
Kaneko et al.

(10) Patent No.: US 8,203,586 B2
(45) Date of Patent: Jun. 19, 2012

(54) IMAGE FORMING APPARATUS HAVING A CLEANING MEMBER CONFIGURED TO CLEAN A TRANSPARENT MEMBER OF AN OPTICAL DEVICE

(75) Inventors: Tamotsu Kaneko, Suntou-gun (JP); Ken-ichi Tomita, Mishima (JP); Shinichi Ueda, Mishima (JP); Kazushi Ino, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 135 days.

(21) Appl. No.: 12/414,438

(22) Filed: Mar. 30, 2009

(65) Prior Publication Data

US 2009/0269102 A1 Oct. 29, 2009

(30) Foreign Application Priority Data

Mar. 31, 2008 (JP) ..... 2008-090198
Mar. 31, 2008 (JP) ..... 2008-090200
Mar. 31, 2008 (JP) ..... 2008-090201

(51) Int. Cl.
*B41J 15/14* (2006.01)
*B41J 27/00* (2006.01)
*G03G 21/00* (2006.01)

(52) U.S. Cl. ..... 347/241; 347/256; 399/98

(58) Field of Classification Search ..... 347/230, 347/241, 256, 238, 242, 257, 258; 399/98, 399/123, 99, 107, 118
See application file for complete search history.

(56) References Cited

U.S. PATENT DOCUMENTS

| | | | | |
|---|---|---|---|---|
| 7,203,444 | B2 * | 4/2007 | Yamazaki | 399/98 |
| 7,352,377 | B2 * | 4/2008 | Matsutomo | 347/136 |
| 7,515,171 | B2 * | 4/2009 | Lim | 347/263 |
| 2004/0240905 | A1 | 12/2004 | Yamazaki | |
| 2006/0001980 | A1 | 1/2006 | Namba | |
| 2007/0070173 | A1 * | 3/2007 | Yamakawa et al. | 347/241 |

FOREIGN PATENT DOCUMENTS

| | | | | |
|---|---|---|---|---|
| JP | 9-160470 | A | | 6/1997 |
| JP | 11-337859 | A | | 12/1999 |
| JP | 2001-343876 | A | | 12/2001 |
| JP | 2001343876 | A | * | 12/2001 |
| JP | 2004-85899 | A | | 3/2004 |
| JP | 2004-301959 | A | | 10/2004 |
| JP | 2005-246901 | A | | 9/2005 |
| JP | 2005-329622 | A | | 12/2005 |
| JP | 2006-44229 | A | | 2/2006 |
| JP | 2006-215225 | A | | 8/2006 |
| JP | 2006215225 | A | * | 8/2006 |

* cited by examiner

*Primary Examiner* — Hai C Pham
(74) *Attorney, Agent, or Firm* — Canon USA Inc. IP Division

(57) ABSTRACT

An image forming apparatus including a laser scanner configured to irradiate a photoconductive drum with light and having a cover glass transmitting the light, a laser shutter movable between a closed position, where the laser shutter blocks an optical path of the light emitted from the laser scanner through the cover glass toward the photoconductive drum, and an open position, where the laser shutter opens the optical path, and a cleaning member with which the cover glass is cleaned, the cleaning member being supported by the laser shutter in such a manner as to be movable along the laser shutter.

36 Claims, 13 Drawing Sheets

IMAGE FORMING APPARATUS HAVING A CLEANING MEMBER CONFIGURED TO CLEAN A TRANSPARENT MEMBER OF AN OPTICAL DEVICE

BACKGROUND OF THE INVENTION

1. Field of the Invention

The present invention relates to an image forming apparatus, such as a copier, a printer, and/or a facsimile, and in particular to an image forming apparatus having a cleaning member configured to clean a transparent member of an optical device included in the image forming apparatus.

2. Description of the Related Art

In image forming apparatuses, such as a laser printer and a copier, laser light is applied to photoconductive drums, or photosensitive member, in accordance with image signals, causing electrostatic latent images to form on photoconductive drums. The electrostatic latent images are developed with toner, whereby the electrostatic latent images are visualized. Such an image forming apparatus has a casing having an openable/closable cover so that the laser light does not leak outside while the apparatus is under operation.

When replacing process cartridges with new ones, removing a jammed sheet during an operation, or performing a maintenance operation, the openable/closable cover is opened while the main power remains on. Particularly, where laser light is used in the apparatus, it is important to prevent the laser light from leaking outside of the apparatus when the cover is open, even in case of malfunction of an interlocking switch.

The image forming apparatus includes a laser shutter. The laser shutter is provided on an optical scanner or inside the image forming apparatus including the optical scanner, and is configured to operate in conjunction with the attachment and removal of a process cartridge, including a photoconductive drum, and the opening and closing of the cover of the casing of the apparatus. Specifically, when a user or a serviceman opens the cover of the image forming apparatus to attach or remove a process cartridge or to remove a jammed sheet, for example, the laser shutter blocks the optical path of the laser light, thereby preventing the user or the serviceman from being exposed to the laser light.

Japanese Patent Laid-Open No. 11-337859 discloses an exemplary configuration in which a laser shutter is turned in conjunction with the opening and closing of an openable/closable cover when a process cartridge is attached and removed and when a jammed sheet is removed, whereby the laser shutter blocks the optical path of laser light traveling toward a redirecting mirror.

In recent electrophotographic image forming apparatuses using toner as developing material, the toner is often scattered, resulting in dust inside the image forming apparatus. Laser scanners, as exposure units included in such image forming apparatuses, are sensitive to dust, including toner. Therefore, the interior of such a laser scanner is sealed so as to prevent toner and dust from entering thereinside.

The image forming apparatus has an opening through which laser light emitted from the laser scanner passes. To prevent toner and dust from entering the interior of the laser scanner through the opening, a cover glass that allows the laser light to pass therethrough is provided over the opening.

In such a configuration, toner and dust falling from a developing unit in the process cartridge and straying inside a main body of the apparatus may enter the optical path of the laser light and adhere to the cover glass, thereby blocking the optical path. This causes a reduction in the density of a printed image or a missing portion in a printed image. To prevent the reduction in the image density and the occurrence of a missing portion in an image, the image forming apparatus needs to be configured such that toner and dust do not adhere to the cover glass, or such that toner and dust adhered to the cover glass can be removed.

Therefore, a user or a serviceman accesses the interior of the image forming apparatus and wipes the cover glass clean with a soft cloth or the like. However, it is very difficult to thoroughly clean the cover glass, which has only a small surface area, without damaging the surface.

Japanese Patent Laid-Open No. 2005-246901 discloses a cleaning technique of removing toner and dust adhered to a dust-proof glass. Specifically, a cleaning member is slid along the dust-proof glass by a user or a serviceman, whereby toner and dust adhered to the dust-proof glass is removed.

In recent tandem color image forming apparatuses having small sizes and discharging sheets at increasingly high speeds, it is preferred that major components required for image forming are configured and arranged as a small assembly. In particular, a tandem color image forming apparatus, which includes a plurality of photoconductive drums and uses a plurality of laser beams, requires a plurality of image forming units for respective colors. Under such circumstances, it is preferable to design the image forming units as compact as possible.

The tandem color image forming apparatus naturally requires a plurality of laser shutters for protecting the user from the laser beams, resulting in configurational complexity. To provide a laser shutter mechanism, space is necessary between the photoconductive drum and the laser scanner. This reduces the flexibility in arrangement of the components to be included in the image forming area, hindering the size reduction of the apparatus.

Also in the technique of cleaning the dust-proof glass by using a slidable cleaning member disclosed in Japanese Patent Laid-Open No. 2005-246901, a guide member along which the cleaning member is provided separately. This increases the number of components and requires additional space to accommodate the guide member.

SUMMARY OF THE INVENTION

The present invention provides an image forming apparatus in which foreign substances on a transparent member included in the apparatus can be cleaned efficiently with a space-saving configuration.

According to an aspect of the present invention, an image forming apparatus includes an optical device configured to irradiate a photosensitive member with light and having a transparent member transmitting the light, a shutter movable between a closed position, where the shutter blocks an optical path of the light emitted from the optical device through the transparent member toward the photosensitive member, and an open position, where the shutter opens the optical path, and a cleaning member with which the transparent member is cleaned, the cleaning member being slidably attached to the shutter for moving along the shutter.

Further features of the present invention will become apparent from the following description of exemplary embodiments with reference to the attached drawings.

DESCRIPTION OF THE EMBODIMENTS

Embodiments of the present invention will now be described in detail with reference to the accompanying drawings. Dimensions, materials, shapes, relative positions, and the like of elements described herein should be appropriately changed with apparatuses to which the present invention is applied and various conditions thereof, and are not intended to limit the scope of the present invention to the embodiments described below.

Figure 1:
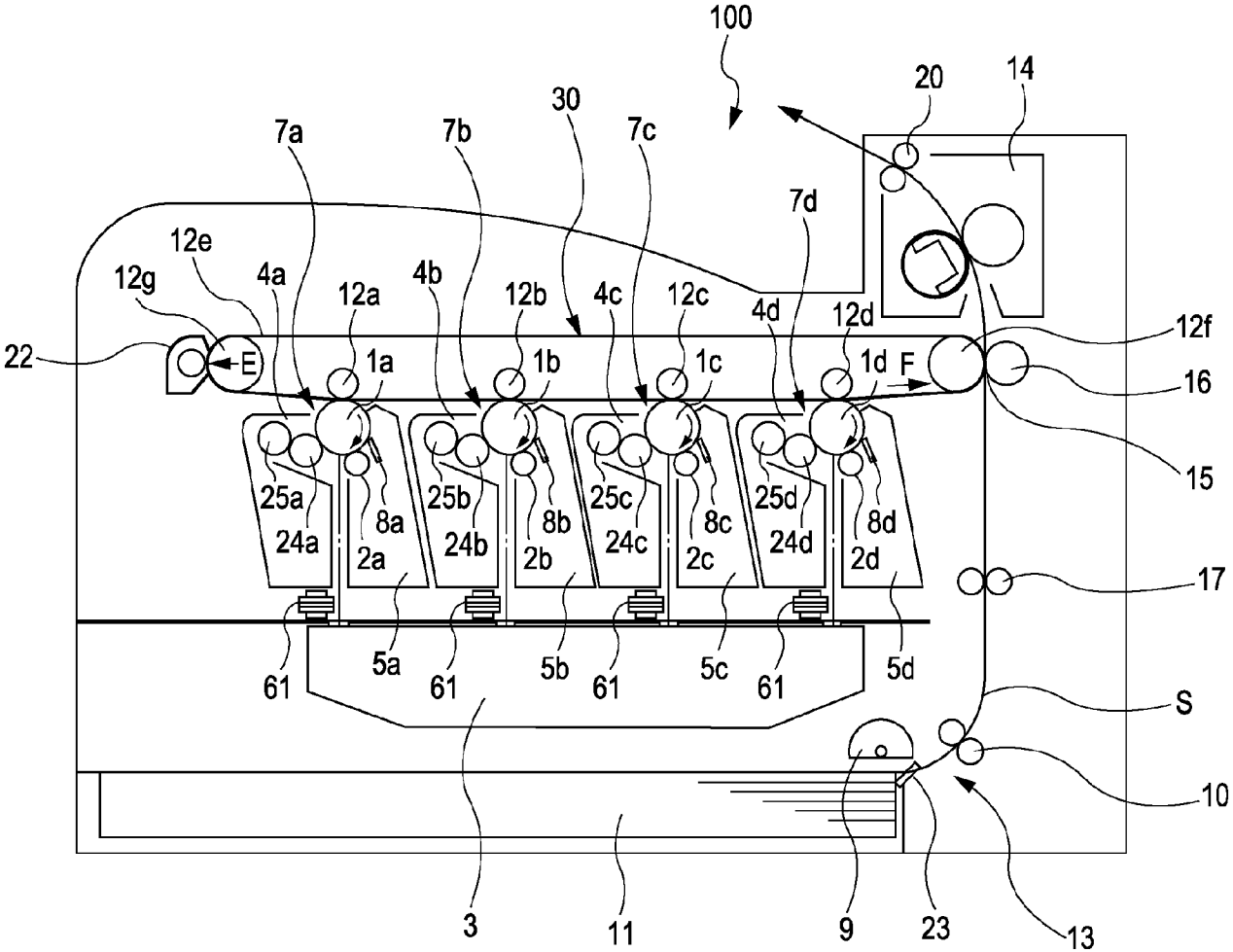
FIG. 1 is a cross-sectional view of a color image forming apparatus according to a first embodiment of the present invention.

FIG. 1 is a longitudinal cross-sectional view showing the overall configuration of a color laser printer 100, functioning as an image forming apparatus, according to a first embodiment of the present invention. The overall configuration of the image forming apparatus, i.e., the color laser printer 100, will now be described.

Overall Configuration of Image Forming Apparatus

Referring to FIG. 1, the color laser printer 100 has four process cartridges 7 (7*a*, 7*b*, 7*c*, and 7*d*), functioning as a first to fourth image forming units. The process cartridges 7 form images in respective colors of yellow, magenta, cyan, and black, and all have the same configuration with different colors of toner. Therefore, reference characters a, b, c, and d added to reference numerals denoting elements shown in FIG. 1 in correspondence with the process cartridges 7 for yellow, magenta, cyan, and black are omitted in the following description unless those elements need to be distinguished from each other by their colors.

Each of the process cartridges 7 includes a rotatable photoconductive drum 1, functioning as a photosensitive member. The process cartridge 7 also includes around the photoconductive drum 1 the following: a charging roller 2 functioning as a charger, a developing unit 4 functioning as a developer, and a cleaning blade 8 functioning as a cleaning unit, which are assembled into a cartridge. The process cartridge 7 is attachable to and removable from a main body of the apparatus (printer).

The process cartridge 7 is a combination of the developing unit 4 and a cleaner unit 5. The developing unit 4 includes a developing roller 24, a toner applying roller 25, and a toner container containing toner having one of the colors of yellow (Y), magenta (M), cyan (C), and black (K). The cleaner unit 5 includes the photoconductive drum 1, the charging roller 2, the cleaning blade 8, and a waste-toner container.

A rotatable intermediate transfer belt unit 30 is provided above the process cartridges 7 in contact with the photoconductive drums 1. A laser scanner 3, functioning as an optical device, is provided below the process cartridges 7.

The laser scanner 3, which is disposed vertically below the process cartridges 7, exposes the photoconductive drums 1 to light in accordance with respective image signals.

With the configuration described above, the photoconductive drums 1 are charged with negative polarity by the respective charging rollers 2, and subsequently the laser scanner 3 forms electrostatic latent images on the respective photoconductive drums 1. The electrostatic latent images are developed as inverted images by the respective developing units 4, with toner having negative polarity being made to adhere thereto. Thus, toner images in respective colors of Y, M, C, and K are obtained.

The intermediate transfer belt unit 30 includes an intermediate transfer belt 12*e* stretched between a driving roller 12*f* and a tension roller 12*g*. A tension in a direction of the arrow E is applied by the tension roller 12*g* to the intermediate transfer belt 12*e*. Primary transfer rollers 12 are provided on the inner periphery of the intermediate transfer belt 12*e* in such a manner as to face the respective photoconductive drums 1. Transfer biases are applied to the primary transfer rollers 12 by respective bias applying units (not shown).

The photoconductive drums 1 rotate in directions of the arrows shown in FIG. 1, the intermediate transfer belt 12*e* rotates in a direction of the arrow F, and biases of positive polarity are applied to the respective primary transfer rollers 12, whereby the toner images on the respective photoconductive drums 1 are subjected to primary transfer, sequentially from the photoconductive drum 1*a*, onto the intermediate transfer belt 12*e*. A resultant image including the toner images of the four colors superimposed one on top of another is conveyed to a secondary transfer nip 15.

A sheet feeding device 13 includes a feeding roller 9 that feeds a sheet S from a sheet cassette 11, in which sheets S are stacked, and a pair of conveying rollers 10 that conveys the sheet S fed thereto.

The sheet cassette 11 can be pulled out frontward in FIG. 1 (toward the front side of the printer 100). A user can supply sheets by removing the sheet cassette 11 from the main body, placing new sheets S into the sheet cassette 11, and inserting the sheet cassette 11 back into the main body.

The feeding roller 9 is pressed against the stack of sheets S in the sheet cassette 11, and a separating pad 23 separates one of the sheets S from the other (a friction-separation method), whereby the sheets S are conveyed one by one.

The sheet S fed from the sheet feeding device 13 is further conveyed by a pair of registration rollers 17 to the secondary transfer nip 15.

A bias of positive polarity is applied to a secondary transfer roller 16 provided at the secondary transfer nip 15, whereby the four-color toner image on the intermediate transfer belt 12*e* is subjected to secondary transfer onto the sheet S.

The sheet S having the toner image transferred thereonto is heated and pressed in a fuser 14, functioning as a fixing unit, so that the toner image is fixed on the sheet S, and is subsequently discharged by a pair of discharging rollers 20 to a discharge tray 21.

The toner remaining on the photoconductive drums 1 after the transfer of the toner images is removed by the respective cleaning blades 8 and is collected into the respective waste-toner containers in the cleaner units 5.

The toner remaining on the intermediate transfer belt 12*e* after the secondary transfer of the toner images onto the sheet S is removed by a transfer belt cleaner 22 and is collected into a waste-toner container (not shown).

Attachment and Removal of A Process Cartridge

Figure 2:
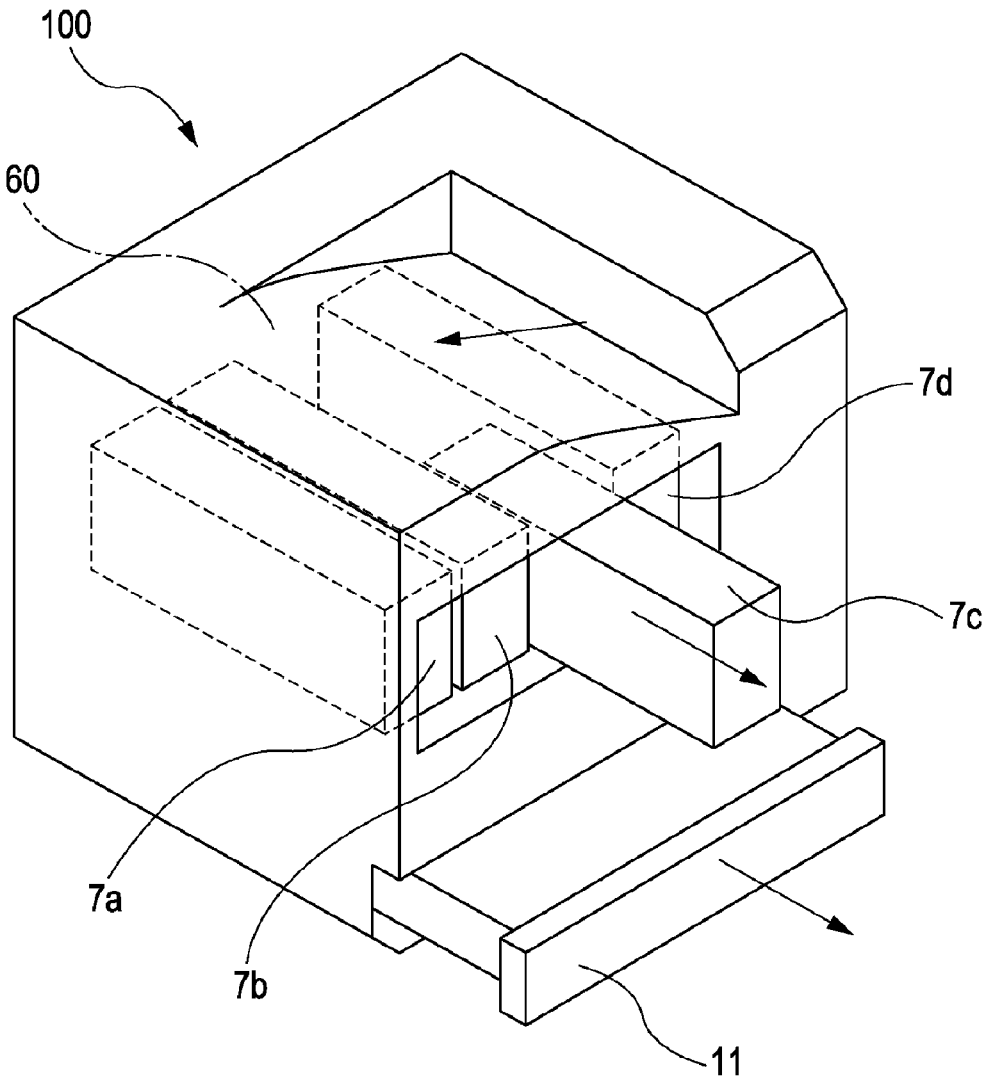
FIG. 2 is a perspective view showing how a process cartridge and a sheet cassette according to the first embodiment are attached and removed.
Figure 3:
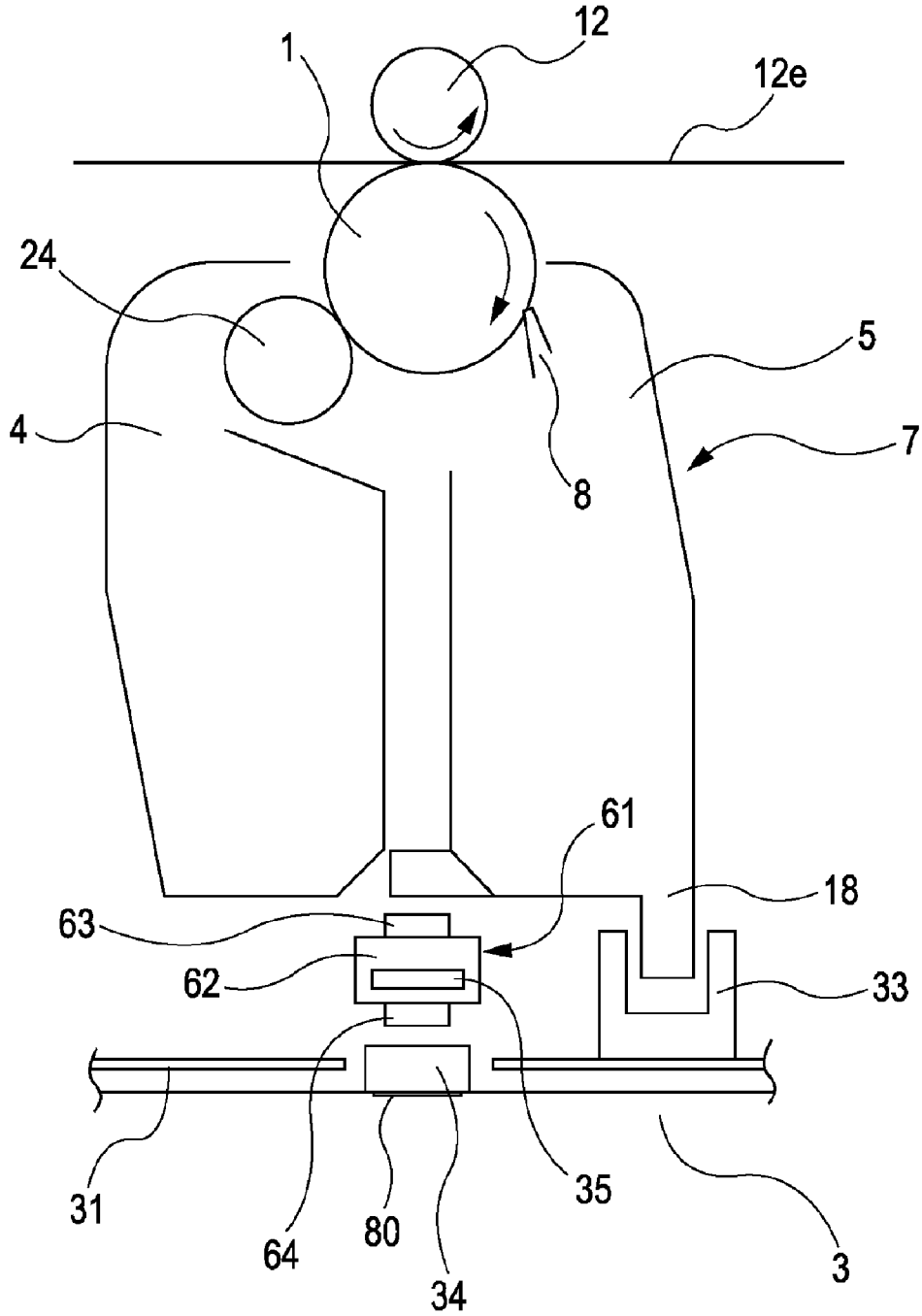
FIG. 3 is a cross-sectional view of the process cartridge and relevant elements provided therearound according to the first embodiment.

Attachment and removal of any of the process cartridges 7 to and from the color laser printer 100 will now be described. FIG. 2 is a perspective view of the color laser printer 100 according to the first embodiment, showing how the process cartridge 7 and the sheet cassette 11 are attached to and removed from the main body. FIG. 3 is a cross-sectional view of one of the process cartridges 7 and relevant elements provided therearound.

In the color laser printer 100, supply of sheets into the sheet cassette 11, attachment and removal of the process cartridges 7, and collection of printed sheets can be performed from the front side of the main body. The process cartridges 7 can be accessed from the front side of the main body and are insertable into and removable from the main body in directions in which the rotational axes of the respective photoconductive drums 1 extend.

Referring to FIG. 2, the main body has a cartridge receiving portion 60, in which guides 33 (FIG. 3) that guide the insertion and removal of the respective process cartridges 7 are provided. To insert or remove any of the process cartridges 7, an openable/closable cover (not shown) is opened first, and the process cartridge 7 is inserted or removed along the corresponding one of the guides 33 in the longitudinal direction (the direction of the rotational axis) of the photoconductive drum 1.

Referring to FIG. 3, the guide 33 is a guide rail that guides a lower portion of the process cartridge 7. The guide 33 is disposed on a partition plate 31 provided between the process cartridge 7 and the laser scanner 3, and has a groove that receives an insertion rib 18 provided as a part of the process cartridge 7. The rear end of the guide 33 in the direction in which the process cartridge 7 is inserted slopes upward so as to form a portion whose level is higher than the other portion (see FIG. 10). Therefore, as described separately below, when the process cartridge 7 is inserted along the guide 33 in the direction of the rotational axis of the photoconductive drum 1, the process cartridge 7 is moved slightly upward, where the process cartridge 7 is properly attached.

Laser Shutter and Cleaning Member

The process cartridge 7, a laser shutter 35, and a cleaning member 61 will now be described with reference to FIG. 3.

The laser scanner 3 of the first embodiment is disposed below the process cartridge 7. The laser scanner 3 has at the top thereof a long narrow opening 80 extending in the longitudinal direction of the photoconductive drum 1 disposed above the laser scanner 3 so that light can be applied to the photoconductive drum 1. To prevent dust and toner particles from entering the interior of the laser scanner 3 through the opening 80, the opening 80 is provided with a cover glass 34, functioning as a transparent member, allowing light transmission therethrough. The cover glass 34 covers the opening 80, thereby sealing the interior of the laser scanner 3. The cover glass 34, having an elongate shape, extends such that the longitudinal direction thereof substantially matches the rotational-axis direction of the photoconductive drum 1, whereby the light emitted toward the photoconductive drum 1 can be transmitted through the cover glass 34.

The laser shutter 35, made of acrylonitrile-butadiene-styrene (ABS) resin colored in black, is disposed directly above the cover glass 34 in such a manner as to block the laser light. The laser shutter 35 has a long narrow shape so as to cover the cover glass 34, and is movable between two positions: a closed position and an open position. At the closed position, the laser shutter 35 blocks the optical path of the light emitted from the laser scanner 3 toward the photoconductive drum 1. At the open position, the laser shutter 35 opens the optical path of the light. When the laser shutter 35 is at the closed position as shown in FIG. 3, the laser light transmitted through the cover glass 34 is blocked by the laser shutter 35 and is not applied to the photoconductive drum 1.

The laser shutter 35 is made of an elastic material and is therefore elastically deformable. In the first embodiment, the laser shutter 35 is made of ABS resin.

The laser shutter 35 is provided with the cleaning member 61, with which the cover glass 34 is cleaned. The cleaning member 61 is wrapped around the laser shutter 35. The cleaning member 61 includes a base member 62 and a wiping member 64. The base member 62 of the first embodiment is made of ABS resin and has a length of about 20 mm. The base member 62 is supported by the laser shutter 35 in such a manner as to be slidable therealong. When the cleaning member 61 supported by the laser shutter 35 at the closed position is moved along the laser shutter 35 in the longitudinal direction of the cover glass 34, which has an elongate shape, the surface of the cover glass 34 is wiped.

The base member 62 of the cleaning member 61 has on the top surface thereof a tab 63 integrally formed therewith. At the time of insertion and removal of the process cartridge 7, the tab 63 engages a portion of the process cartridge 7. This engagement enables the cleaning member 61 to slide along the laser shutter 35 in conjunction with the insertion and removal of the process cartridge 7.

The wiping member 64 is configured to adhere to the bottom surface of the base member 62. The wiping member 64 of the first embodiment is constituted by a piece of urethane foam having a thickness of 2 mm and a hardness of about 100 N and a piece of polyester nonwoven cloth having a thickness of 1.5 mm, the pieces being welded together. In FIG. 3 where the process cartridge 7 is properly attached in the cartridge receiving portion 60, the piece of polyester nonwoven cloth of the wiping member 64 and the cover glass 34 are spaced apart from each other.

Laser Shutter Supporting Mechanism

Figure 4:
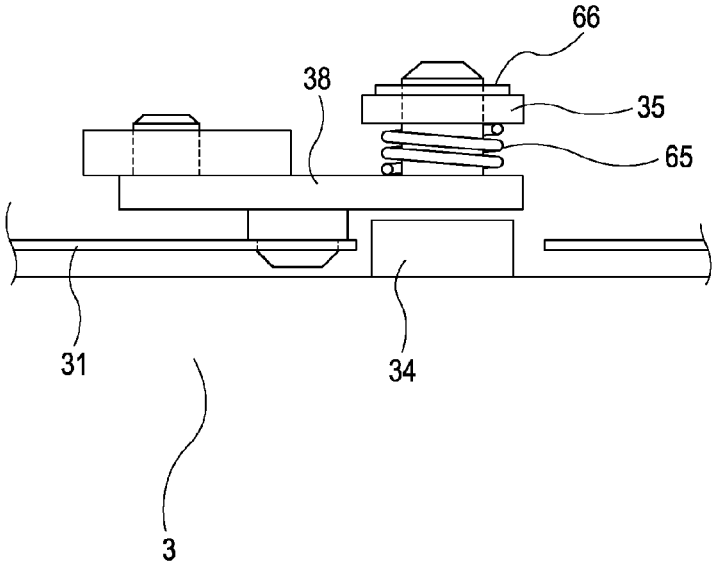
FIG. 4 is a cross-sectional view of a laser shutter and relevant elements provided therearound according to the first embodiment.
Figure 5:
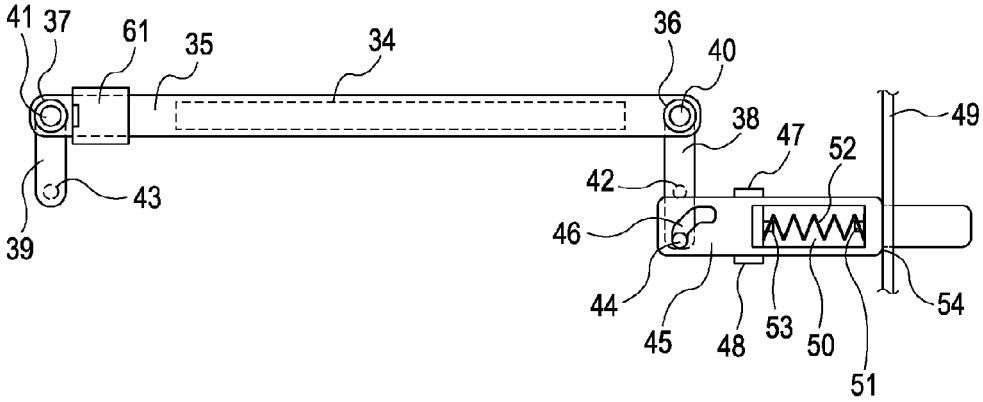
FIG. 5 is a top view of the laser shutter according to the first embodiment at a closed position.

A mechanism of supporting the laser shutter 35 will now be described with reference to FIGS. 4 and 5. FIG. 4 is a cross-sectional view showing the laser shutter 35 and relevant elements provided therearound, when the color laser printer 100 is seen from the front, as in FIG. 3. FIG. 5 is a top view of the laser shutter 35 at the closed position.

Referring to FIG. 5, the laser shutter 35 is movable between the open position and the closed position with the aid of a link mechanism. Specifically, both ends of the laser shutter 35 are supported by swivel arms 38 and 39, which are provided below the laser shutter 35 and included in the link mechanism. The swivel arms 38 and 39 can swivel about swivel fulcrum bosses 42 and 43, respectively. The swivel arms 38 and 39 each have at one end thereof a cylindrical boss 40 or 41. The cylindrical bosses 40 and 41 are fitted in circular holes 36 and 37, respectively, provided at the ends of the laser shutter 35, thereby supporting the laser shutter 35 while being rotatable in the circular holes 36 and 37.

Referring to FIG. 4, a compression spring 65, functioning as a first biasing member, is disposed between the laser shutter 35 and each of the swivel arms 38 and 39. The compression springs 65 bias the laser shutter 35 in such a direction that the laser shutter 35 is moved away from the cover glass 34. Specifically, the laser shutter 35 is biased upward in FIG. 4, but is positioned by E-rings 66 fitted to the cylindrical bosses 40 and 41 of the swivel arms 38 and 39, respectively, so as not to come off the cylindrical bosses 40 and 41.

Laser Shutter Opening/Closing Mechanism

A mechanism for opening and closing the laser shutter 35 will now be described with reference to FIGS. 5 to 7. FIG. 5 shows the laser shutter 35 at the closed position blocking the optical path of the laser light. The dashed lines in FIG. 5 indicate the position of the cover glass 34 hidden behind the laser shutter 35.

Referring to FIG. 5, the laser shutter 35 has at the ends thereof the circular holes 36 and 37, respectively. The cylindrical bosses 40 and 41 of the swivel arms 38 and 39 are fitted in the circular holes 36 and 37, respectively. Thus, the laser shutter 35 is swingably supported. The swivel arms 38 and 39 have on the bottom surfaces thereof the swivel fulcrum bosses 42 and 43, respectively. The swivel fulcrum bosses 42 and 43, provided as parts of the respective swivel arms 38 and 39, are fitted in respective holes (not shown) provided in the partition plate 31. The swivel arms 38 and 39 are supported in such a manner as to be swivelable about the respective swivel fulcrum bosses 42 and 43. With such a configuration, the laser shutter 35 can be moved by the link mechanism with respect to the cover glass 34 provided over the laser scanner 3, which is fixed to the main body.

The laser shutter 35 supports at the left end thereof the cleaning member 61 such that the cleaning member 61 is movable therealong. The cleaning member 61 shown in FIG. 5 has been moved from right to left in the longitudinal direction of the cover glass 34 while sliding on the surface of the cover glass 34, together with the movement of the process cartridge 7 inserted into the cartridge receiving portion 60.

The swivel arm 38 has on the top surface thereof a cylindrical engaging boss 44 at an end across the swivel fulcrum boss 42 from the boss 40. The engaging boss 44, provided as a part of the swivel arm 38, engages with a deformed hole 46 provided in a slider 45 disposed over the swivel arm 38.

The slider 45 is regulated by guides 47 and 48, which are formed by bending two portions of the partition plate 31 upright, so as not to be movable in the vertical direction in FIG. 5, but is slidable horizontally (in the longitudinal direction of the slider 45). One end of the slider 45 passes through a regulating hole (not shown) provided in a front plate 49 of the main body so as to project toward the front side of the main body. The slider 45 has in a middle portion thereof an opening 50. A projection 51 projects at an end on the inner peripheral wall of the opening 50. A compression spring 52, functioning as a second biasing member, has the right end thereof fitted to the projection 51.

Figure 6:
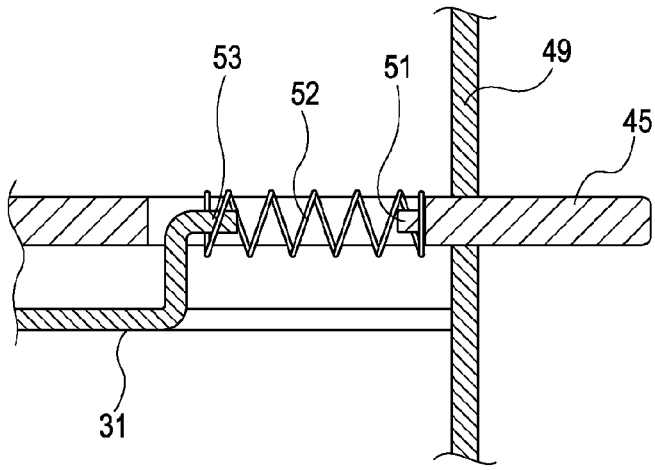
FIG. 6 is a cross-sectional view of a slider-biasing mechanism according to the first embodiment.

FIG. 6 is a left-side cross-sectional view of the slider 45 and the compression spring 52. As can be seen from FIG. 6, the left end of the compression spring 52 is fitted to a spring supporting portion 53, which is formed by bending a portion of the partition plate 31. Accordingly, the slider 45 is biased rightward in FIG. 6 by a spring pressure of the compression spring 52. The slider 45 also has on the sides thereof stepped portions 54 (see FIG. 5). When the stepped portions 54 comes into contact with the front plate 49, functioning as a stopper, the slider 45 stops sliding.

The opening and closing movements of the laser shutter 35 will now be described. FIG. 7 shows a state where an image forming operation is ready to be performed, i.e., a state where a front door 26, functioning as the openable/closable cover of the main body, is closed and the laser shutter 35 is at the open position, retracted from the optical path of the laser light.

When the slider 45 slides, the engaging boss 44 fitted in the deformed hole 46 moves. For example, referring to FIG. 7, when the front door 26 is closed, a projection 27 provided on the inner surface of the front door 26 pushes the end of the slider 45. This causes the slider 45 to slide in a direction of the arrow A and the engaging boss 44 to move along the deformed hole 46, whereby the swivel arm 38 swivels about the swivel fulcrum boss 42 in a direction of the arrow B shown in FIG. 7. Consequently, the laser shutter 35 turnably supported at the cylindrical boss 40 moves to the position shown in FIG. 7. The swivel arm 39 supporting the other end of the laser shutter 35 swivels about the swivel fulcrum boss 43 in a direction of the arrow C, following the movement of the laser shutter 35. When the front door 26 is closed, the laser shutter 35 retracts from the position directly above the cover glass 34, whereby the laser light emitted from the laser scanner 3 can be applied to the photoconductive drum 1.

Figure 7:
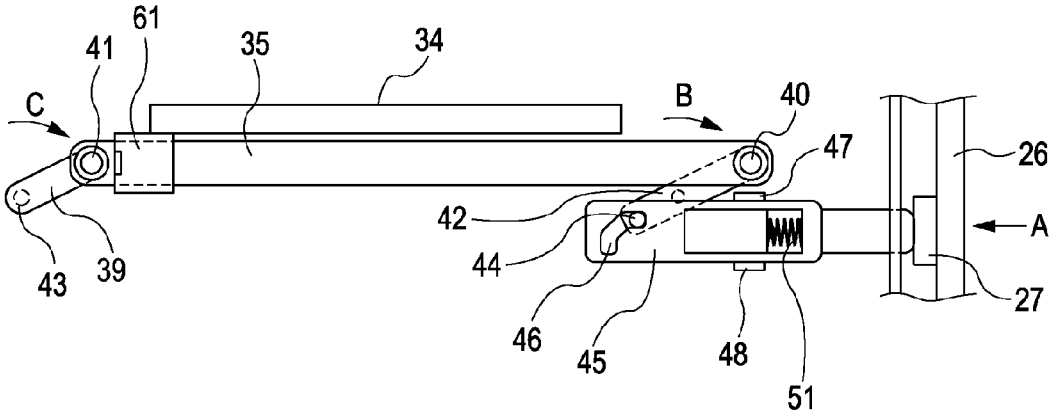
FIG. 7 is a top view of the laser shutter according to the first embodiment at an open position.

When the front door 26 in the state shown in FIG. 7 is opened, the end of the slider 45 is released from the pushing force of the projection 27, and the biasing force applied by the compression spring 52 causes the slider 45 to slide toward right in FIG. 7. With this sliding, the engaging boss 44, which is fitted in the deformed hole 46, moves and the swivel arms 38 and 39 swivel in the reverse directions of the arrows B and C, respectively, whereby the laser shutter 35 moves to the position shown in FIG. 5. The laser shutter 35 is moved to the position directly above the cover glass 34, i.e., the closed position, where the laser shutter 35 blocks the optical path of the laser light.

Figure 8:
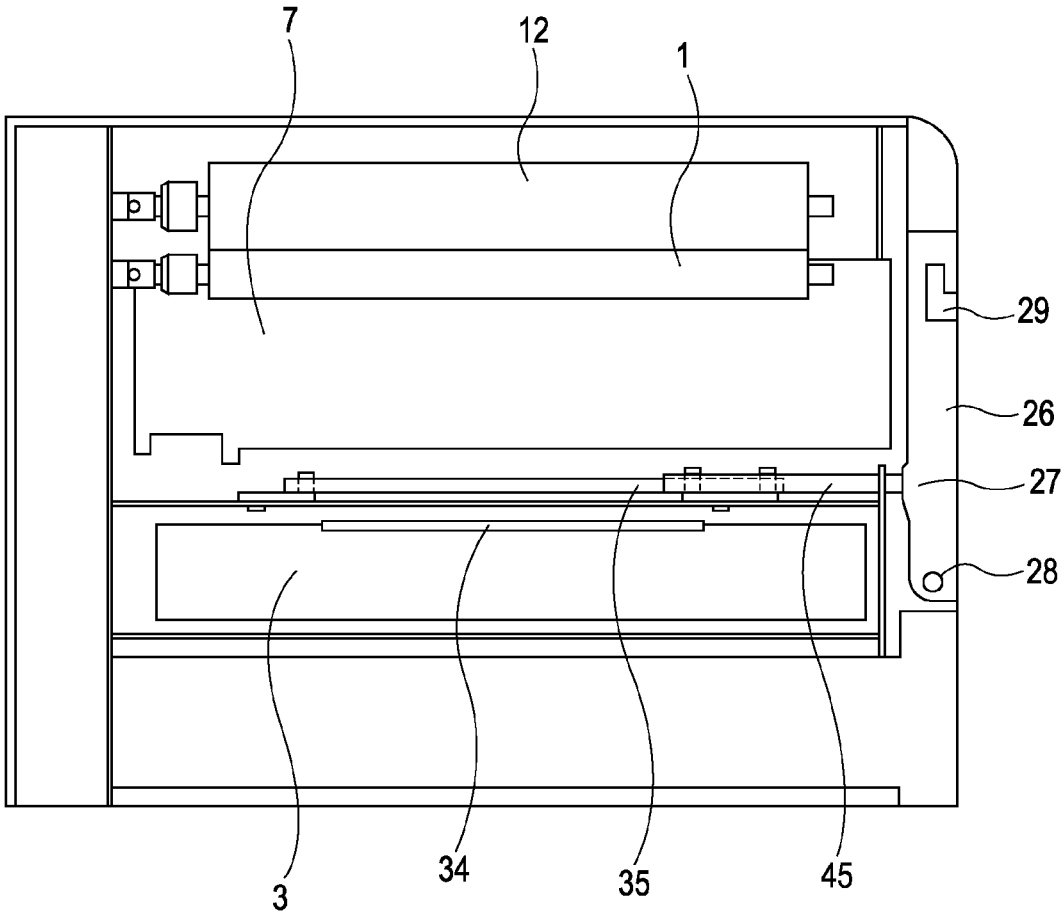
FIG. 8 is a left-side cross-sectional view of the image forming apparatus according to the first embodiment.

FIG. 8 is a left-side cross-sectional view of the color laser printer 100. The front door 26 is shown on the right side in FIG. 8 (on the front side of the main body). The front door 26 functions as an outer cover of the printer 100 and as a door to be opened and closed when the process cartridge 7 is attached to and removed from the main body. The front door 26 has at the bottom thereof a fulcrum shaft 28, and is supported by the main body in such a manner as to be turnable about the fulcrum shaft 28. The front door 26 also has at the top thereof a latch (not shown), with which the front door 26 holds onto the main body.

To replace the process cartridge 7 with a new one, a user can pull the front door 26 by holding a handle 29. Then, the latch is released from the main body and the front door 26 opens. When the front door 26 is opened, the slider 45 slides toward right in FIG. 8, whereby the laser shutter 35 is moved to the closed position.

By opening the front door 26 in attaching and removing the process cartridge 7, the laser shutter 35 is moved to a position directly above the cover glass 34. Therefore, dust and toner particles floating around and falling toward the cover glass 34 because of the impact of attaching and removing the process cartridge 7 can be prevented from adhering to the surface of the cover glass 34.

Insertion and Removal of Process Cartridge and Movement of Cleaning Member

Insertion and removal of the process cartridge 7 and movement of the cleaning member 61 will now be described with reference to FIGS. 9A to 11C.

Figure 9A:
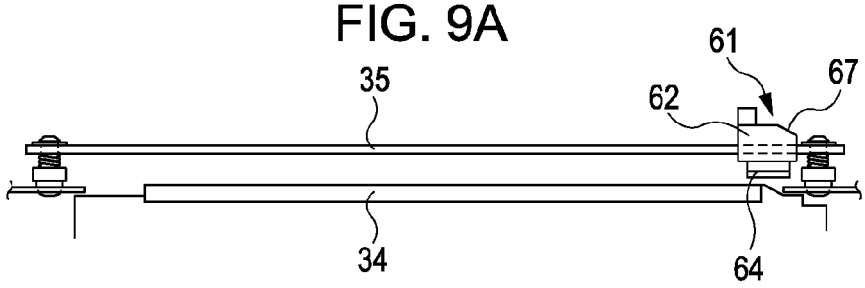
FIGS. 9A to 9D are cross-sectional views showing how a cleaning member slides during insertion of the process cartridge in the first embodiment.

FIGS. 9A to 9D are side views of the cover glass 34 and the laser shutter 35. In FIGS. 9A to 9D, the front side of the main body is on the right. The process cartridge 7 to be attached to the main body is inserted from the front side toward the cartridge receiving portion 60. FIG. 9A shows a state where the process cartridge 7 is yet to be inserted.

The laser shutter 35 is biased upward by the compression springs 65 provided on both ends thereof. The cleaning member 61, which is supported by the laser shutter 35, is positioned such that the wiping member 64 is spaced apart from the cover glass 34. The process cartridge 7 has a rib 68 at a bottom leading end thereof in the direction of insertion.

Figure 9B:
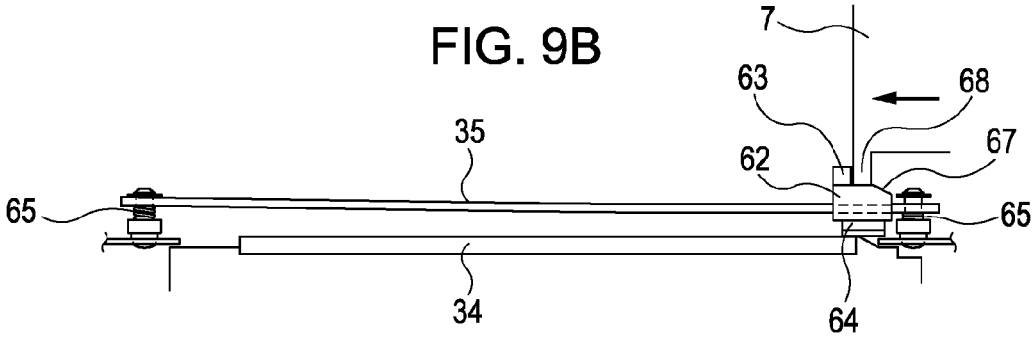

When the process cartridge 7 is inserted, referring to FIG. 9B, the rib 68 first interferes with the base member 62. However, the rib 68 is not caught by the base member 62, but presses down the cleaning member 61 with the aid of a sloping surface 67 of the base member 62, and then engages with the tab 63 of the cleaning member 61. This pressing force makes the laser shutter 35 bend downward against the biasing force applied by the compression springs 65, and brings the cleaning member 61 into contact with the cover glass 34.

The laser shutter 35 elastically deforms so as to be convex downward at a position where the cleaning member 61 resides, whereby the wiping member 64 is in contact with the cover glass 34.

Figure 9C:
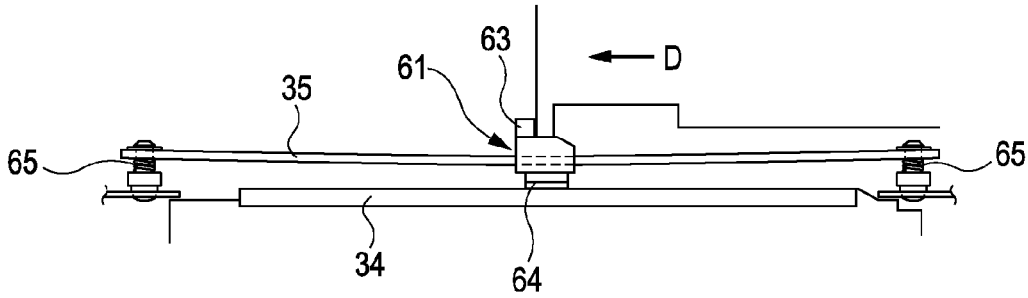

Referring to FIG. 9C, the process cartridge 7 is further inserted in a direction of the arrow D, with the cleaning member 61 being in contact with the cover glass 34. As the process cartridge 7 proceeds, the wiping member 64 is pushed by the process cartridge 7 and slides along the laser shutter 35 while maintaining contact with the cover glass 34. Thus, the cover glass 34 is cleaned with the cleaning member 61. In this configuration, the laser shutter 35 also functions as a member that guides the sliding of the cleaning member 61. Because the cleaning member 61, which is supported by the laser shutter 35, moves along the laser shutter 35, there is no need of providing a member dedicated for guiding the movement of the cleaning member 61. Therefore, a laser shutter function and a cleaning function can be efficiently provided within a limited space.

While the process cartridge 7 is being inserted and removed, the laser shutter 35 is at the position shown in FIG. 5. In this state, when the cleaning member 61, supported by the laser shutter 35, slides along the laser shutter 35 in the longitudinal direction of the cover glass 34 together with the insertion of the process cartridge 7, the frictional resistance produced by the sliding movement of the cleaning member 61 acts to drag the laser shutter 35 in the direction in which the cleaning member 61 slides. However, even if a force to rotate the swivel arm 38 counterclockwise in FIG. 5, is applied to the swivel arm 38, the slider 45, engaging with the engaging boss 44, cannot be moved rightward because of the front plate 49, functioning as the stopper. This prevents the swivel arm 38 from swiveling. Therefore, even if the cleaning member 61 slides with the insertion of the process cartridge 7, the laser shutter 35 does not move from the closed position above the cover glass 34, and functions as a guide that supports the cleaning member 61. When inserting the process cartridge 7, the cover glass 34 can be cleaned with the cleaning member 61 sliding along the laser shutter 35.

As can be seen from FIG. 9C, the laser shutter 35, biased upward with the biasing force applied by the compression springs 65 provided at both ends thereof, elastically deforms so as to be convex downward at the position where the cleaning member 61 engaging with the process cartridge 7 resides.

Figure 9D:
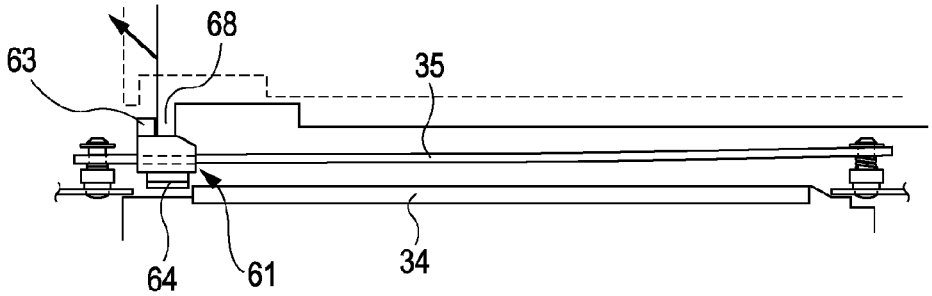

As the process cartridge 7 further proceeds, cleaning with the wiping member 64 is finished. The cleaning member 61 reaches a cleaning end position, as shown in FIG. 9D. The process cartridge 7, which is regulated to be inserted along a predetermined path, is further moved in a direction of the arrow (obliquely upward) shown in FIG. 9D. Then, the rib 68 is released from the tab 63, and the process cartridge 7 is ultimately placed at a position indicated by the dashed lines in FIG. 9D.

The laser shutter 35, which supports and guides the cleaning member 61, is made of an elastic material, and elastic deformation of the laser shutter 35 is utilized to maintain a specific relative positional relationship between the cleaning member 61 and the cover glass 34. In such a configuration, if dimensions of relevant elements are controlled such that the direction in which the cover glass 34, which is to be cleaned, extends and the path along which the process cartridge 7 is inserted are parallel to each other, the extent of pressing the wiping member 64 against the cover glass 34 can be made constant.

Moreover, the state where the cleaning member 61 and the cover glass 34 are spaced apart from each other can also be produced with a simple configuration. When cleaning is not necessary, the wiping member 64 of the cleaning member 61 can be kept away from any other elements. Therefore, deterioration of the wiping member 64 may be reduced.

This means that the laser shutter 35, also functioning as a slide guide for the cleaning member 61, is not necessarily fabricated with high rigidity and high accuracy. Therefore, a cleaning mechanism having high reliability can be provided with a simple, low-cost, space-saving configuration.

In addition, because the cleaning is performed in the longitudinal direction of the cover glass 34, the wiping member 64 can be provided with a small size, whereby the manufacturing cost and size of the printer 100 can be reduced while a sufficient level of reliability in cleaning performance is maintained.

A mechanism of moving the process cartridge 7 obliquely upward at a point immediately before the end of the insertion path, as mentioned above, will now be described with reference to FIGS. 10A to 10C.

Figure 10A:
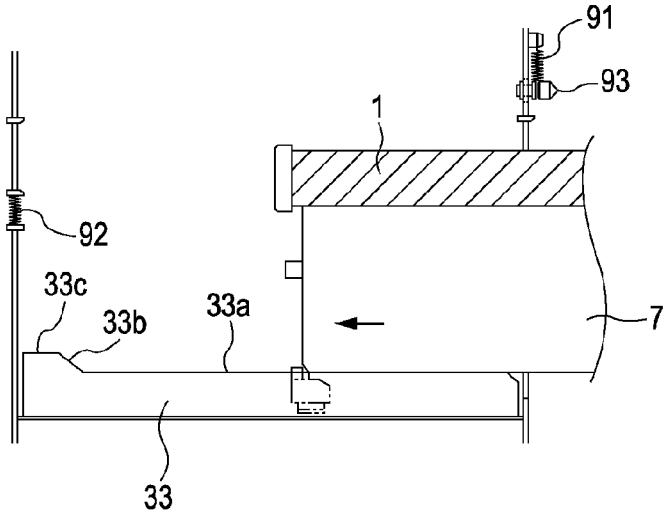
FIGS. 10A to 10C are cross-sectional views showing how the process cartridge is inserted in the first embodiment.
Figure 10B:
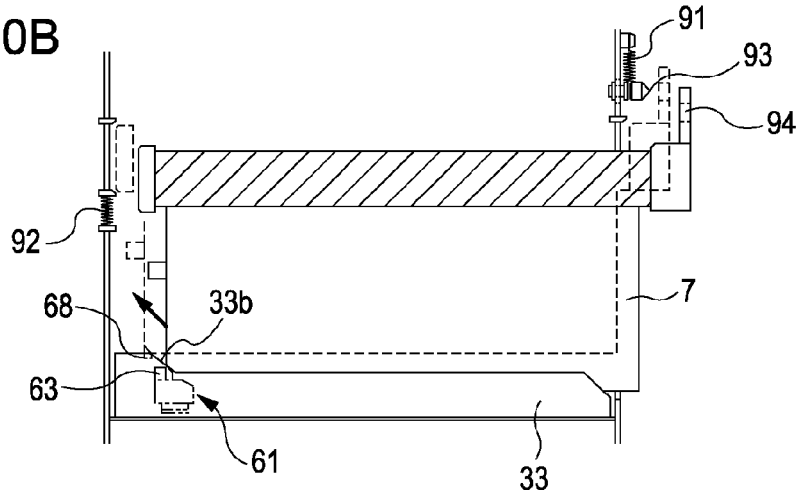
Figure 10C:
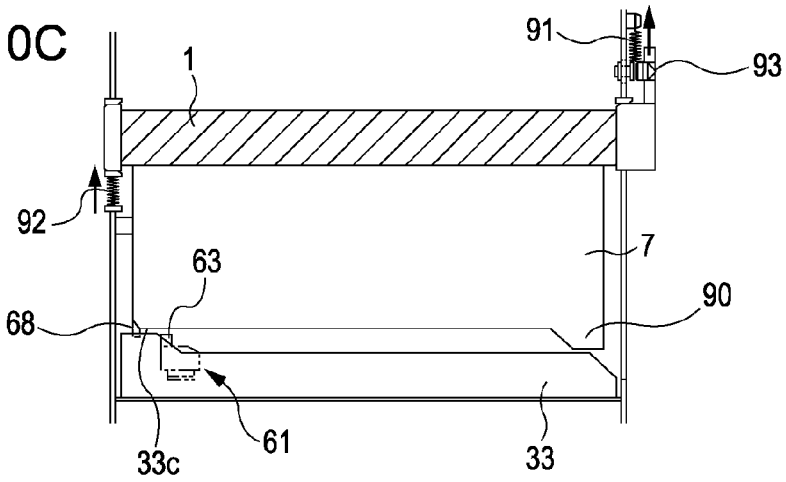

Referring to FIG. 10A, the process cartridge 7 is inserted by being guided along the guide 33 provided in the main body. The guide 33 includes a first guide 33*a*, and at the end of the insertion path a second guide 33*b* and a third guide 33*c*. The first guide 33*a* guides the process cartridge 7 upon insertion into the main body. The second guide 33*b* is a continuation of the first guide 33*a* and slopes obliquely upward. The third guide 33*c* is a continuation of the second guide 33*b* and resides at a level higher than the first guide 33*a*.

The process cartridge 7 to be inserted is guided by the first guide 33*a* into the main body, with the cleaning member 61 wiping the cover glass 34 clean. Referring to FIG. 10B, at a point immediately before the end of the insertion path, the process cartridge 7 rides on the second guide 33*b* and then the third guide 33*c*. Then, referring to FIG. 10C, a projection 90 provided at the trailing end, in the insertion direction, at the bottom of the process cartridge 7 rides on the first guide 33*a*. With this movement, the process cartridge 7 moves upward and the rib 68 is released from the tab 63.

The process cartridge 7 that has moved upward is lifted up by lift springs 91 and 92. Specifically, the lift spring 91, having at an end thereof a locking boss 93, is provided on the front wall at the mouth of the cartridge receiving portion 60, and the locking boss 93 is fitted into a locking hole 94 provided in the process cartridge 7, whereby the process cartridge 7 is lifted up. The lift spring 92 is provided on the rear wall of the cartridge receiving portion 60. The lift spring 92 pushes up a portion of the process cartridge 7 that has moved upward. The process cartridge 7 is lifted up.

An operation of removing the process cartridge 7 properly attached in the main body will now be described with reference to FIGS. 11A to 11C.

Figure 11A:
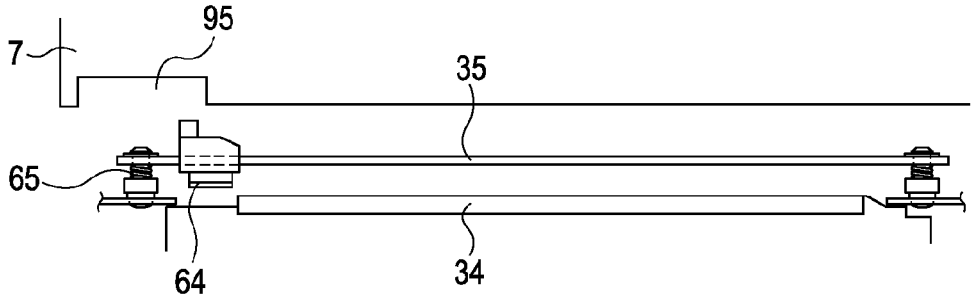
FIGS. 11A to 11C are cross-sectional views showing how the cleaning member slides during removal of the process cartridge in the first embodiment.

FIG. 11A shows a state where the color laser printer 100 is ready to perform a color-image-forming operation. In this state, the wiping member 64 is held at a distance from the cover glass 34. The laser shutter 35 is supported by the compression springs 65 provided at both ends thereof, maintaining a distance from the cover glass 34.

In a state where the process cartridge 7 is properly attached in the main body, the cleaning member 61 resides in the rear of the main body. When the process cartridge 7 in this state is pulled, the process cartridge 7 is lowered along the sloping surface of the second guide 33*b*. Then, the rib 68 at the bottom end of the process cartridge 7 comes into contact with the left-side surface of the tab 63 at the top of the cleaning member 61. Referring to FIG. 11B, the process cartridge 7 has a recess 95 in a portion at the bottom thereof adjoining the rib 68. While the process cartridge 7 is being lowered along the second guide 33*b* (see FIGS. 10A to 10C), the cleaning member 61 is not pressed down by the process cartridge 7 because the recess 95 is positioned above the cleaning member 61. The cleaning member 61 can be kept away from the cover glass 34.

Figure 11B:
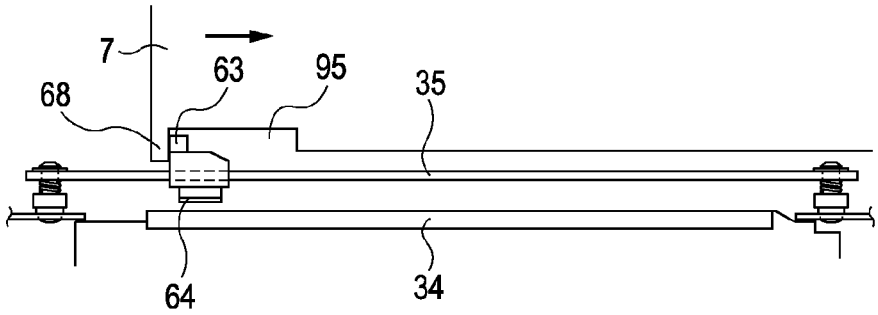

While the foregoing state is maintained, the process cartridge 7 moves rightward in FIG. 11B, together with the cleaning member 61. In this case, the cleaning member 61 moves with the wiping member 64 thereof being spaced apart from the cover glass 34. Such a return movement of the cleaning member 61 to the cleaning start position with the wiping member 64 being spaced apart from the cover glass 34 produces the following advantages.

First, contamination of the cover glass 34 occurring in a case where the cleaning member 61 is moved back with the wiping member 64 being in contact with the cover glass 34 can be prevented.

Another advantage is as follows. During cleaning, the wiping member 64 is pressed against the cover glass 34 and is therefore subjected to stress and frictional resistance. If the wiping member 64 remains in contact with the cover glass 34 when the cleaning member 61 is moved back to the cleaning start position, the wiping member 64 has to be durable for twice the number of cleaning operations performed.

In contrast, in the case where the cleaning member 61 is moved back to the cleaning start position with the wiping member 64 being spaced apart from the cover glass 34, the wiping member 64 can be made of a material whose durability against frictional resistance is not very high.

Instead of nonwoven cloth or the like employed as the material for the wiping member 64 of the cleaning member 61, a cleaning member having directionality in performing cleaning, such as a blade or a scraper, can be employed.

Figure 11C:
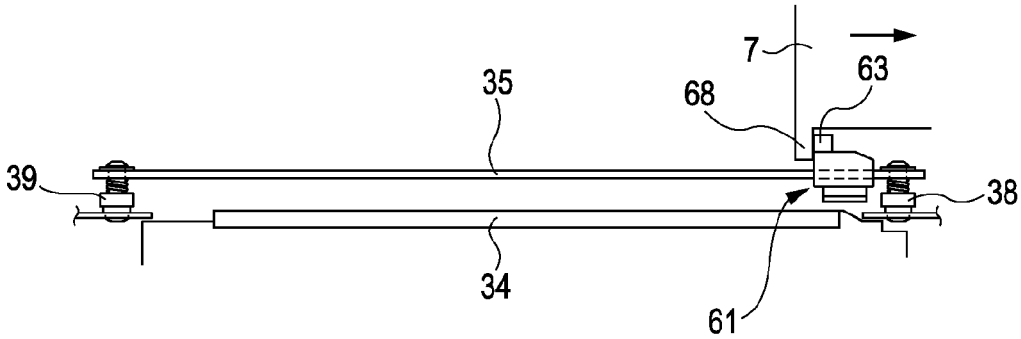
Figure 12:
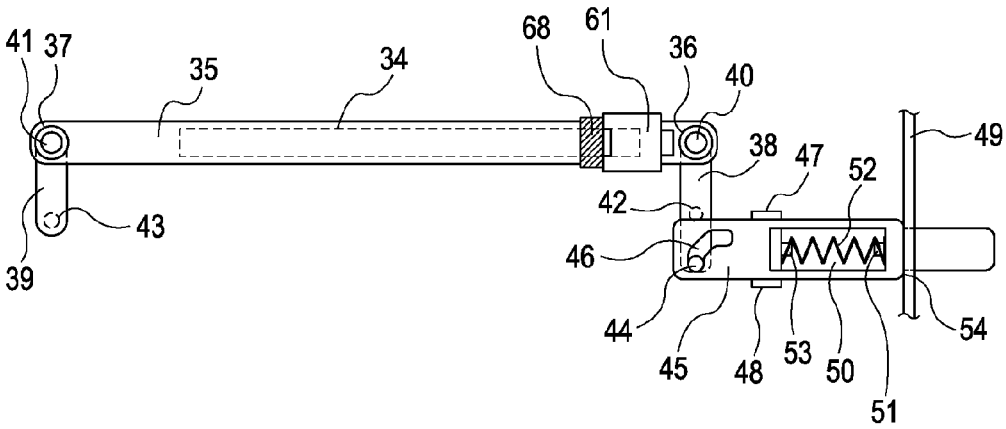
FIG. 12 shows a mechanism of how engagement between the cleaning member and the process cartridge is lost in the first embodiment.

When the process cartridge 7 is further pulled, referring to FIG. 11C, the cleaning member 61 reaches the cleaning start position and is stopped by an anti-climber provided on the laser shutter 35. FIG. 12 is a top view showing the state where the cleaning member 61 that has been moving is stopped by the anti-climber provided on the laser shutter 35. When the process cartridge 7 in the foregoing state is further pulled, the laser shutter 35 shown in FIG. 12 is further moved rightward.

Figure 13:
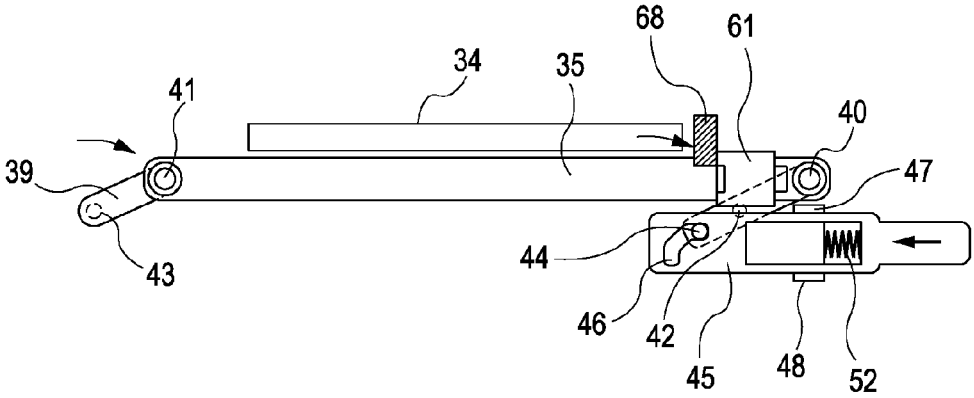
FIG. 13 shows a mechanism of how engagement between the cleaning member and the process cartridge is lost in the first embodiment.

When the laser shutter 35 in the state shown in FIG. 12 is further moved rightward, then referring to FIG. 13, the swivel arms 38 and 39, supporting the laser shutter 35, swivel clockwise and cause the slider 45 to slide in a direction indicated by the arrow, against the biasing force applied by the compression spring 52 biasing the slider 45. Thus, the laser shutter 35 is moved toward the open position, as shown in FIG. 13, together with the cleaning member 61, whereby the rib 68 of the process cartridge 7 is released from the tab 63 of the cleaning member 61. The process cartridge 7 can be removed from the main body.

The frictional resistance produced between the laser shutter 35 and the cleaning member 61 is set so as to be smaller than the force that causes the swivel arms 38 and 39 to swivel against the biasing force of the compression spring 52. Therefore, the rib 68 is not released from the tab 63 before the cleaning member 61 sliding along the laser shutter 35 while the process cartridge 7 is being pulled is brought into contact with the anti-climber provided on the laser shutter 35.

When the process cartridge 7 is completely removed from the main body, the slider 45 is moved back by the biasing force of the compression spring 52 to a position where the stepped portions 54 thereof comes into contact with the front plate 49. The laser shutter 35 is moved to and settled at the closed position, as shown in FIG. 12.

The resistance produced in releasing the process cartridge 7 from the cleaning member 61 in order to completely remove the process cartridge 7 from the main body includes forces that bias the swivel arms 38 and 39 to swivel. Therefore, a cleaning mechanism that is movable and reliable can be provided.

Although the laser shutter 35 of the first embodiment is made of ABS resin, the laser shutter 35 may alternatively be made of metal, such as stainless steel for use as springs. If the posture of the cleaning member can be stabilized by utilizing the elastic deformation characteristic of the laser shutter 35, the same advantages as those described above are obtained.

Although the cleaning operation in the first embodiment is performed by making the tab 63 of the process cartridge 7 directly engage with the cleaning member 61, another element included in the printer 100 may be alternatively utilized as long as the cleaning member 61 can move in conjunction with the insertion and removal of the process cartridge 7. For example, where the process cartridge 7 is properly installed in the main body, a drawer unit insertable into and removable from the main body may be made to engage with the cleaning member 61.

Although the process cartridge 7 of the first embodiment has been described as an exemplary unit that is attachable to and removable from the main body, the process cartridge 7 is not limited thereto. The process cartridge 7 may alternatively be any other unit that is attached to and removed from the main body by a user in ordinary usage. For example, the process cartridge 7 may be the aforementioned drawer unit, or a sheet cassette that is inserted into and removed from the main body in supplying sheets. The cleaning member 61 can be moved in conjunction with operations of attaching and removing a unit performed by a user in ordinary usage. The cover glass 34 can be cleaned without performing a special operation for cleaning.

A second embodiment of the present invention will now be described. The second embodiment features a configuration including a regulating member that regulates the movement of the cleaning member 61 so that, when the laser shutter 35 is at the open position, the cleaning member 61 does not enter and stays outside an irradiation area provided for the laser scanner 3 to irradiate the photoconductive drum 1 with light.

The basic configuration of an apparatus, i.e., a printer, according to the second embodiment is the same as in the first embodiment. Therefore, redundant description is omitted and features specific to the second embodiment will only be described in detail. Elements having the same or similar functions as those in the first embodiment are denoted by the same reference numerals.

A mechanism in which the movement of the cleaning member 61 is regulated by the regulating member when the laser shutter 35 is at the open position will first be described with reference to FIGS. 14 to 16.

Figure 14:
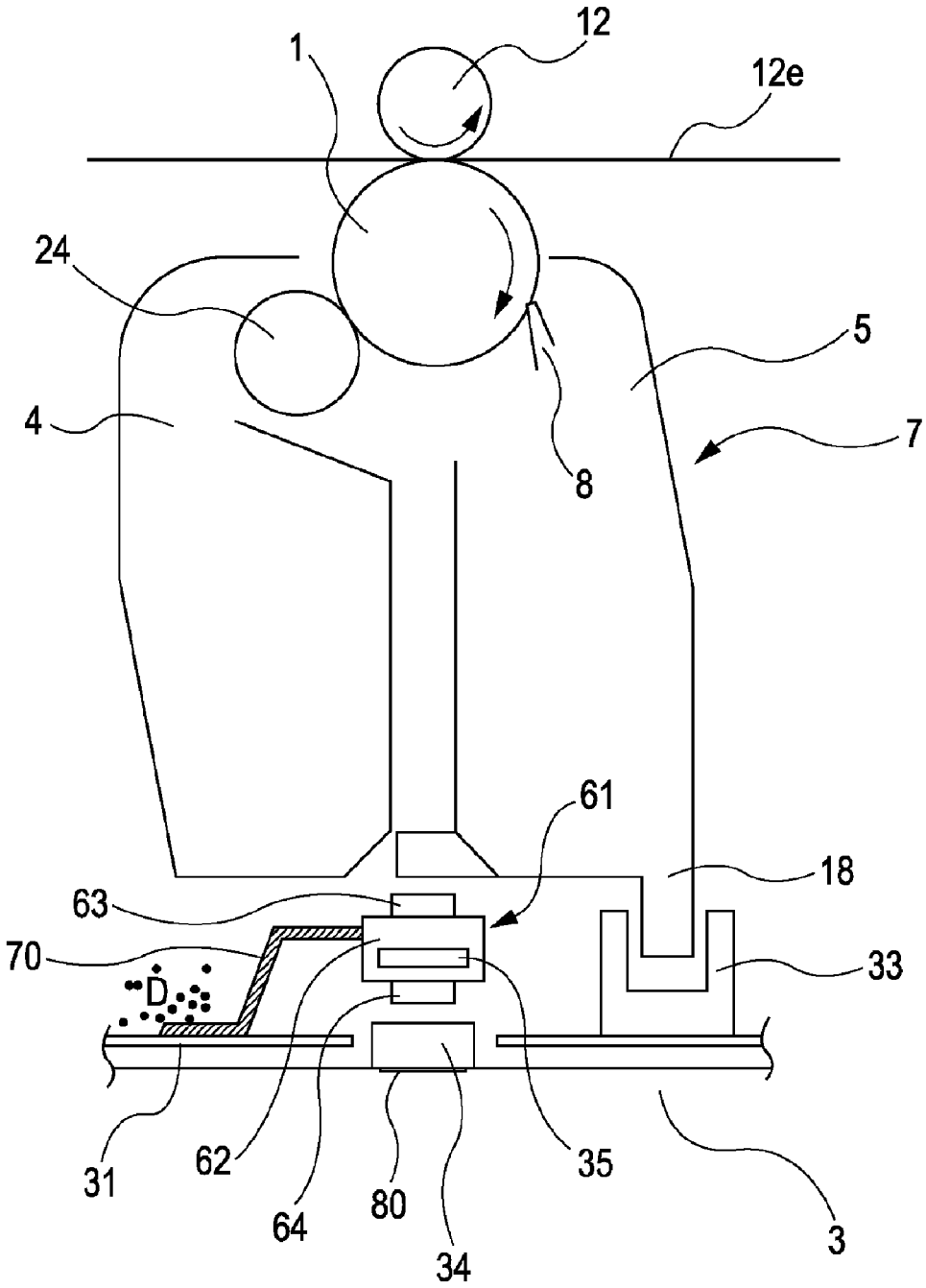
FIG. 14 is a cross-sectional view of a laser shutter and a cleaning member according to a second embodiment of the present invention.

Referring to FIG. 14, the printer 100 according to the second embodiment includes a shading member 70, functioning as a cover, extending in the longitudinal direction of the cover glass 34. The shading member 70 is disposed near the cover glass 34, avoiding the irradiation area. The shading member 70, which is made of a plate member that is bent into a shade-like shape, prevents toner and dust particles D adhering around the cover glass 34 from moving toward and adhering to the cover glass 34. With the shading member 70, the probability of dust particles adhering to the cover glass 34 can be reduced.

Figure 15:
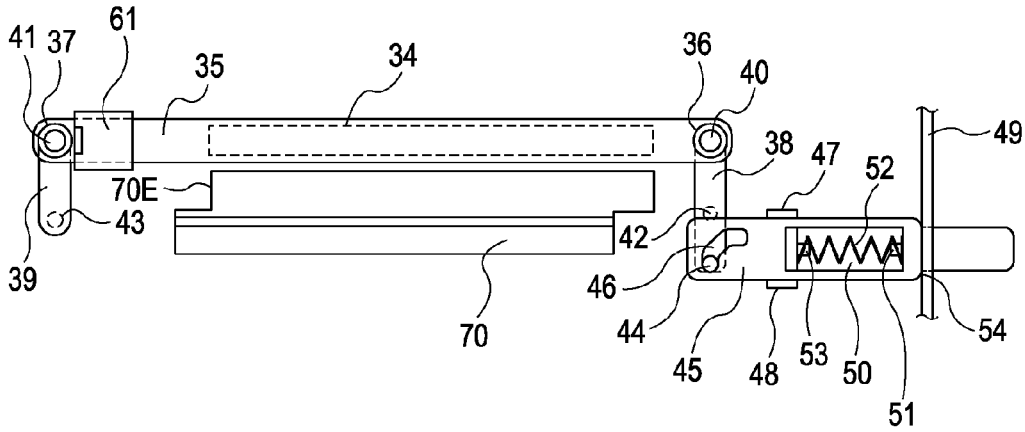
FIG. 15 is a top view of the laser shutter according to the second embodiment at a closed position.

Referring to FIG. 15, when the laser shutter 35 is at the closed position, the range of movement of the cleaning member 61 in the longitudinal direction of the cover glass 34 does not overlap the shading member 70. In contrast, referring to FIG. 16, when the laser shutter 35 is at the open position, the range of movement of the cleaning member 61 in the longitudinal direction of the cover glass 34 partially overlap the shading member 70. The shading member 70 is positioned such that an end 70E thereof resides outside the irradiation area.

When the laser shutter 35 is at the open position, the cleaning member 61 resides outside the irradiation area provided for laser light irradiation by the laser scanner 3, and near the end 70E of the shading member 70.

Figure 16:
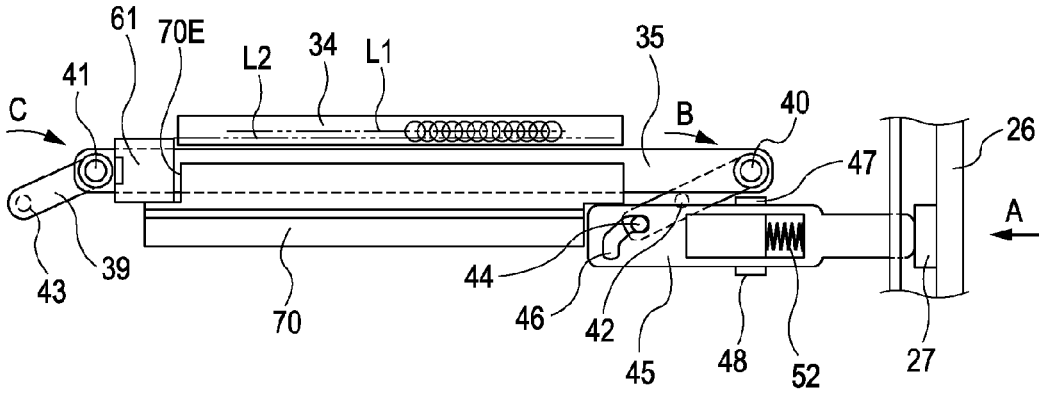
FIG. 16 is a top view of the laser shutter according to the second embodiment at an open position.

In such a configuration, when the laser shutter 35 is at the open position as shown in FIG. 16, where the image forming operation is ready to be performed, the cleaning member 61 cannot enter the irradiation area even if the cleaning member 61 starts to slide along the laser shutter 35 in the longitudinal direction of the cover glass 34, because the cleaning member 61 is stopped by the end 70E of the shading member 70. Thus, when the laser shutter 35 is at the open position, there is no chance of the cleaning member 61 blocking the optical path of the laser light even if the cleaning member 61 is moved by vibration or the like.

In FIG. 16, a plurality of circular marks represent spots of laser scanning light, and a line L1 passing through the centers of the spots represents the irradiation area. If the cleaning member 61 could move toward the right in the state shown in FIG. 16 without being regulated by the shading member 70, the cleaning member 61 would undesirably enter the irradiation area, moving along a path represented by a line L2. However, in the second embodiment, the cleaning member 61 is stopped by the shading member 70, also functioning as a regulating member, so as not to enter the irradiation area.

According to the second embodiment, as in the first embodiment, because the cleaning member 61, which is supported by the laser shutter 35, moves along the laser shutter 35, there is no need of providing a member dedicated for guiding the movement of the cleaning member 61. Therefore, a laser shutter function and a cleaning function can be efficiently provided within a limited space.

The shading member 70 of the second embodiment also functions as a regulating member that regulates the movement of the cleaning member 61 when the laser shutter 35 is at the open position. If the printer 100 is subjected to vibration or impact from the outside, or if the printer 100 is transported with the process cartridges 7 mounted thereon, the cleaning member 61 can be prevented from entering the irradiation area and blocking the optical path of the laser light.

A third embodiment of the present invention will now be described with reference to FIGS. 17 and 18. The basic configuration of an apparatus, i.e., a printer, according to the third embodiment is the same as in the second embodiment. Therefore, redundant description is omitted and features specific to the third embodiment will only be described. Elements having the same or similar functions as those in the second embodiment are denoted by the same reference numerals.

The second embodiment has been described by taking an exemplary configuration including the shading member 70 also functioning as a regulating member that regulates the movement of the cleaning member 61. The third embodiment features a configuration in which the movement of the cleaning member 61 is regulated by a locking member that operates in conjunction with the movement of the laser shutter 35, which is moved by the link mechanism, to the open position.

Figure 17:
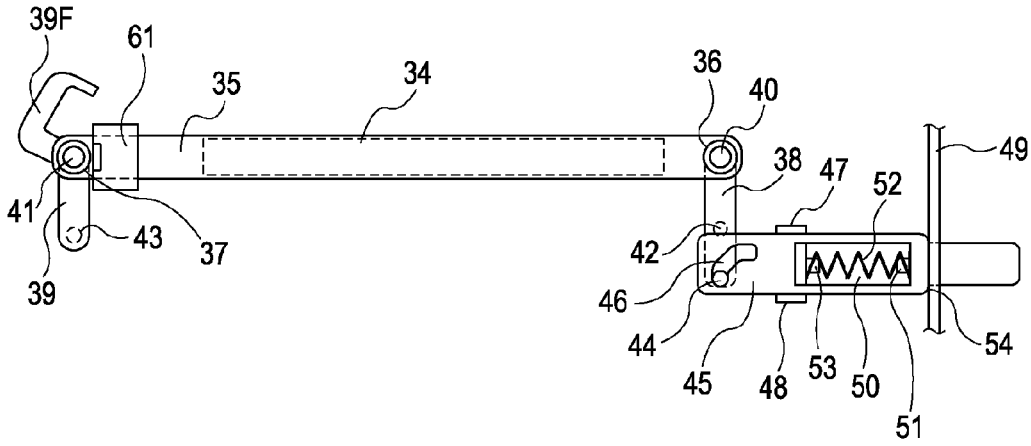
FIG. 17 is a top view of a laser shutter according to a third embodiment of the present invention at a closed position.
Figure 18:
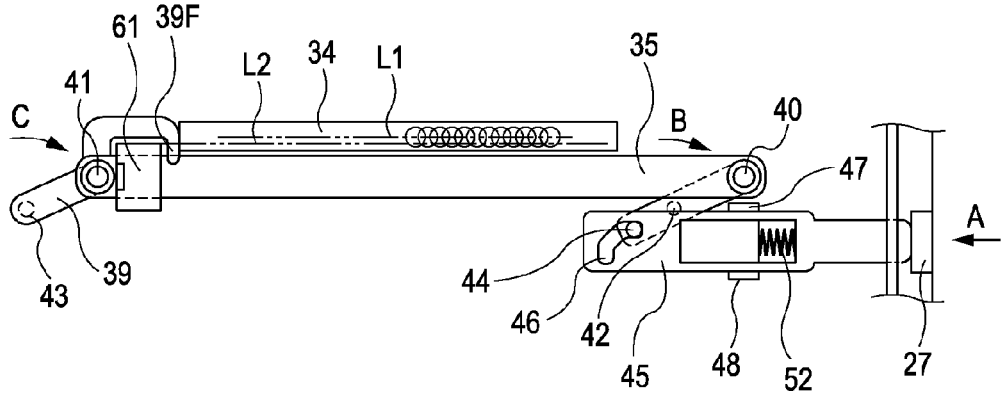
FIG. 18 is a top view of the laser shutter according to the third embodiment at an open position.

FIG. 17 shows a state where the laser shutter 35 is at the closed position, blocking the optical path of the laser light. FIG. 18 shows a state where the laser shutter 35 is at the open position, without blocking the optical path of the laser light. Referring to FIGS. 17 and 18, the configuration according to the third embodiment includes a hook 39F, functioning as the locking member, integrally provided at an end of the swivel arm 39, which is included in the link mechanism and provided at an end of the laser shutter 35 in the rear of the main body. When the swivel arm 39 swivels such that the laser shutter 35 is moved to the open position, the hook 39F locks the cleaning member 61.

Specifically, referring to FIG. 17, when the laser shutter 35 is at the closed position directly above the cover glass 34, the hook 39F is open. When the front door 26 is closed and the laser shutter 35 is moved to the open position, as shown in FIG. 18, where the laser shutter 35 is retracted from the position directly above the cover glass 34, the phase of the hook 39F changes and the hook 39F locks the cleaning member 61 provided in the rear of the main body. The cleaning member 61 is regulated so as not to move toward the cleaning start position. Therefore, in the state where the image forming operation is ready to be performed, the cleaning member 61 cannot move to a position blocking the optical path of the laser light.

According to the third embodiment, as in the cases of the first and second embodiments, because the cleaning member 61, which is supported by the laser shutter 35, moves along the laser shutter 35, there is no need of providing a member dedicated for guiding the movement of the cleaning member 61. Therefore, a laser shutter function and a cleaning function can be efficiently provided within a limited space.

The swivel arm 39 of the third embodiment has the hook 39F. Therefore, even if the printer 100 is subjected to vibration or impact from the outside, or if the printer 100 is transported with the process cartridges 7 mounted thereon, the cleaning member 61 can be prevented from entering the irradiation area and blocking the optical path of the laser light.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-090198 filed on Mar. 31, 2008, No.

2008-090200 filed on Mar. 31, 2008, and No. 2008-090201 filed on Mar. 31, 2008, which are hereby incorporated by reference herein in their entirety.

What is claimed is:

1. An image forming apparatus comprising:

an optical device configured to irradiate a photosensitive member with light and having a transparent member transmitting the light;

a shutter movable between a closed position, where the shutter blocks an optical path of the light emitted from the optical device through the transparent member toward the photosensitive member, and an open position, where the shutter opens the optical path; and a cleaning member cleaning the transparent member, the cleaning member being supported by the shutter, wherein the cleaning member moves with respect to the shutter so as to clean the transparent member in a state where the shutter is held at the closed position.

2. The image forming apparatus according to claim 1, wherein the cleaning member is in contact with the transparent member while moving from a cleaning start position to a cleaning end position, and the cleaning member is not in contact with the transparent member while moving from the cleaning end position to the cleaning start position.

3. The image forming apparatus according to claim 2, wherein the shutter is made of an elastic material and is elastically deformed while the cleaning member is moved from the cleaning start position to the cleaning end position, enabling the cleaning member to contact the transparent member.

4. The image forming apparatus according to claim 2, further comprising:

a first biasing member biasing the shutter in a direction opposite the transparent member, wherein a biasing force produced by the first biasing member keeps the cleaning member away from the transparent member while the cleaning member moves from the cleaning end position to the cleaning start position.

5. The image forming apparatus according to claim 1, wherein the transparent member has an elongate shape, the cleaning member being configured to move with respect to the shutter in a direction parallel to a longitudinal direction of the transparent member.

6. The image forming apparatus according to claim 5, further comprising:

a unit attachable to and removable from a main body of the apparatus; and a unit-receiving portion in which the unit is received, wherein the cleaning member moves parallel to the longitudinal direction of the transparent member in conjunction with insertion of the unit into the unit-receiving portion.

7. The image forming apparatus according to claim 6, wherein the shutter is held at the closed position while the cleaning member moves in the direction parallel to the longitudinal direction of the transparent member such that the cleaning member is moving from a cleaning start position to a cleaning end position, in a state where the cleaning member is in engagement with the unit, in conjunction with the insertion of the unit into the unit-receiving portion, wherein after the cleaning member in engagement with the unit moves in the direction parallel to the longitudinal direction of the transparent member in conjunction with the removal of the unit from the unit-receiving portion such that the cleaning member moves from the cleaning end position to the cleaning start position, the shutter starts to move from the closed position toward the open position, and wherein the cleaning member is disengaged from the unit when the shutter is moved from the closed position toward the open position.

8. The image forming apparatus according to claim 7, further comprising:

a second biasing member biasing the shutter in a direction in which the shutter is caused to move from the open position to the closed position; and a stopper configured to regulate a range in which the shutter is moved by a biasing force produced by the second biasing member, wherein the stopper regulates the range up to the closed position so that the shutter is held at the closed position for the entire period while the cleaning member in engagement with the unit is moving parallel to the longitudinal direction of the transparent member in conjunction with the insertion of the unit into the unit-receiving portion.

9. The image forming apparatus according to claim 8, wherein the shutter, pressed by the cleaning member, starts to move toward the open position, against the biasing force produced by the second biasing member, while the cleaning member in engagement with the unit is moving parallel to the longitudinal direction of the transparent member in conjunction with the removal of the unit from the unit-receiving portion, and wherein the cleaning member is disengaged from the unit when the shutter is moved toward the open position.

10. The image forming apparatus according to claim 6, wherein the unit is a cartridge including the photosensitive member and attachable to and removable from the main body, and the unit-receiving portion is a cartridge-receiving portion in which the cartridge is received.

11. The image forming apparatus according to claim 10, wherein the photosensitive member is rotatable, wherein the cartridge is insertable into and removable from the main body in a direction of a rotational axis of the photosensitive member, and wherein the direction of the rotational axis of the photosensitive member is parallel to the longitudinal direction of the transparent member.

12. The image forming apparatus according to claim 1, further comprising:

a regulating member configured to regulate movement of the cleaning member, wherein, when the shutter is at the open position, the regulating member regulates the movement of the cleaning member residing outside an irradiation area in which the optical device irradiates the photosensitive member with light, so that the cleaning member slidably attached to the shutter is prevented from entering the irradiation area by moving along the shutter.

13. The image forming apparatus according to claim 12, wherein the transparent member has an elongate shape, the cleaning member being configured to move along the shutter parallel to a longitudinal direction of the transparent member.

14. The image forming apparatus according to claim 13, further comprising:

a cover configured to prevent dust from adhering to the transparent member, the cover being disposed outside the irradiation area and parallel to the longitudinal direction of the transparent member, the cover also functioning as the regulating member.

15. The image forming apparatus according to claim 12, further comprising:

a link mechanism configured to move the shutter between the closed position and the open position and having a locking member capable of locking the cleaning member in conjunction with the shutter moving toward the open position, wherein, when the shutter is at the open position, the link mechanism causes the locking member to lock the cleaning member, whereby the locking member also functions as the regulating member.

16. The image forming apparatus according to claim 1, further comprising:

a door openable and closable with respect to a main body of the apparatus, wherein the shutter moves between the closed position and the open position in conjunction with opening and closing of the door.

17. The image forming apparatus according to claim 1, further comprising:

a plurality of photosensitive members, wherein the plurality of photosensitive members are each exposed to light so that an image of a different color is formed; and a plurality of cleaning members cleaning a corresponding transparent member.

18. An image forming apparatus comprising:

an optical device configured to irradiate a photosensitive member with light and having a transparent member transmitting the light;

a shutter movable between a closed position, where the shutter blocks an optical path of the light emitted from the optical device through the transparent member toward the photosensitive member, and an open position, where the shutter opens the optical path; and a cleaning member cleaning the transparent member, the cleaning member being supported by the shutter movably with respect to the shutter, wherein the cleaning member moves in a direction intersecting a direction in which the shutter moves between the closed position and the open position.

19. The image forming apparatus according to claim 18, wherein the transparent member has an elongate shape, and the cleaning member moves with respect to the shutter in the direction parallel to the longitudinal direction of the transparent member.

20. The image forming apparatus according to claim 19, further comprising:

a unit attachable to and removable from a main body of the apparatus; and a unit-receiving portion in which the unit is received, wherein the cleaning member moves parallel to the longitudinal direction of the transparent member in conjunction with insertion of the unit into the unit-receiving portion.

21. The image forming apparatus according to claim 20, wherein the shutter is held at the closed position while the cleaning member moves in the direction parallel to the longitudinal direction of the transparent member such that the cleaning member is moving from a cleaning start position to a cleaning end position, in a state where the cleaning member is in engagement with the unit, in conjunction with the insertion of the unit into the unit-receiving portion, wherein after the cleaning member in engagement with the unit moves in a direction parallel to the longitudinal direction of the transparent member such that the cleaning member moves from the cleaning end position to the cleaning start position in conjunction with the removal of the unit from the unit-receiving portion, the shutter starts to move from the closed position toward the open position, and wherein the cleaning member is disengaged from the unit when the shutter is moved from the closed position toward the open position.

22. The image forming apparatus according to claim 21, further comprising:

a second biasing member biasing the shutter in a direction in which the shutter is caused to move from the open position to the closed position; and a stopper configured to regulate a range in which the shutter is moved by a biasing force produced by the second biasing member, wherein the stopper regulates the range up to the closed position so that the shutter is held at the closed position for the entire period while the cleaning member in engagement with the unit is moving parallel to the longitudinal direction of the transparent member in conjunction with the insertion of the unit into the unit-receiving portion.

23. The image forming apparatus according to claim 22, wherein the shutter, pressed by the cleaning member, starts to move toward the open position, against the biasing force produced by the second biasing member, while the cleaning member in engagement with the unit is moving parallel to the longitudinal direction of the transparent member in conjunction with the removal of the unit from the unit-receiving portion, and wherein the cleaning member is disengaged from the unit when the shutter is moved toward the open position.

24. The image forming apparatus according to claim 20, wherein the unit is a cartridge including the photosensitive member and attachable to and removable from the main body, and the unit-receiving portion is a cartridge-receiving portion in which the cartridge is received.

25. The image forming apparatus according to claim 24, wherein the photosensitive member is rotatable, wherein the cartridge is insertable into and removable from the main body in a direction of a rotational axis of the photosensitive member, and wherein the direction of the rotational axis of the photosensitive member is parallel to the longitudinal direction of the transparent member.

26. The image forming apparatus according to claim 18, wherein the cleaning member is in contact with the transparent member while moving from a cleaning start position to a cleaning end position, and the cleaning member is not in contact with the transparent member while moving from the cleaning end position to the cleaning start position.

27. The image forming apparatus according to claim 26, wherein the shutter is made of an elastic material and is elastically deformed while the cleaning member is moved from the cleaning start position to the cleaning end position, enabling the cleaning member to contact the transparent member.

28. The image forming apparatus according to claim 26, further comprising:

a first biasing member biasing the shutter in a direction opposite the transparent member, wherein a biasing force produced by the first biasing member keeps the cleaning member away from the transparent member while the cleaning member moves from the cleaning end position to the cleaning start position.

29. The image forming apparatus according to claim 18, further comprising:

a regulating member configured to regulate movement of the cleaning member, wherein, when the shutter is at the open position, the regulating member regulates the movement of the cleaning member residing outside an irradiation area in which the optical device irradiates the photosensitive member with light, so that the cleaning member slidably attached to the shutter is prevented from entering the irradiation area by moving along the shutter.

30. The image forming apparatus according to claim 29, wherein the transparent member has an elongate shape, the cleaning member being configured to move along the shutter parallel to a longitudinal direction of the transparent member.

31. The image forming apparatus according to claim 30, further comprising:

a cover configured to prevent dust from adhering to the transparent member, the cover being disposed outside the irradiation area and parallel to the longitudinal direction of the transparent member, the cover also functioning as the regulating member.

32. The image forming apparatus according to claim 30, further comprising:

a link mechanism configured to move the shutter between the closed position and the open position and having a locking member capable of locking the cleaning member in conjunction with the shutter moving toward the open position, wherein, when the shutter is at the open position, the link mechanism causes the locking member to lock the cleaning member, whereby the locking member also functions as the regulating member.

33. The image forming apparatus according to claim 18, further comprising:

a door openable and closable with respect to a main body of the apparatus;

wherein the shutter moves between the closed position and the open position in conjunction with the opening and closing of the door.

34. The image forming apparatus according to claim 18, further comprising:

a plurality of photosensitive members, wherein the plurality of photosensitive members are exposed to light so that an image of a different color is formed; and a plurality of cleaning members cleaning a corresponding transparent member.

35. An image forming apparatus comprising:

a door openable and closable with respect to a main body of the apparatus;

a unit-receiving portion in which a unit is attached;

an optical device configured to irradiate a photosensitive member with light and having a transparent member transmitting the light;

a shutter movable between a closed position, where the shutter blocks an optical path of the light emitted from the optical device through the transparent member toward the photosensitive member, and an open position, where the shutter opens the optical path; and a cleaning member configured to move with respect to the transparent member so as to clean the transparent member, wherein the shutter moves between the closed position and the open position in conjunction with opening and closing of the door, wherein the cleaning member moves in conjunction with insertion of the unit into the unit-receiving portion so as to clean the transparent member, and wherein the cleaning member is supported by the shutter in such a way that the cleaning member is movable with respect to the shutter.

36. The image forming apparatus according to claim 35, wherein the cleaning member moves in a longitudinal direction of the transparent member so as to clean the transparent member.

* * * * *